US005509784A

United States Patent [19]

Caruso et al.

[11] Patent Number: 5,509,784

[45] Date of Patent: Apr. 23, 1996

[54] TURBINE BUCKET AND WHEEL ASSEMBLY WITH INTEGRAL BUCKET SHROUD

[75] Inventors: David A. Caruso; Robert E. Deallenbach, both of Schenectady; William D. Gordon, Scotia; Raymond J. Jones, Duanesburg; Alexander Morson, Clifton Park, all of N.Y.

[73] Assignee: General Electric Co., Schenectady, N.Y.

[21] Appl. No.: 280,898

[22] Filed: Jul. 27, 1994

[51] Int. Cl.[6] ..... F01D 5/16; F01D 5/22; F01D 5/26

[52] U.S. Cl. ..... 416/222; 416/191; 416/190

[58] Field of Search ..... 416/222, 191, 416/190

[56] References Cited

U.S. PATENT DOCUMENTS

| | | | |
|---|---|---|---|
| 1,149,366 | 8/1915 | Herr . | |
| 1,247,400 | 11/1917 | Herr . | |
| 1,423,466 | 7/1922 | Snyder . | |
| 2,220,918 | 11/1940 | Smith . | |
| 2,315,611 | 4/1943 | Franck . | |
| 2,942,843 | 6/1960 | Sampson . | |
| 3,107,897 | 10/1963 | Varadi et al. | 416/191 |
| 3,185,441 | 5/1965 | Reuter . | |
| 3,328,867 | 7/1967 | Guengant | 416/190 |
| 3,572,968 | 3/1971 | Musick et al. . | |
| 3,752,599 | 4/1973 | Pace . | |
| 3,981,615 | 9/1976 | Krol . | |
| 4,710,102 | 12/1987 | Ortolano | 416/190 |
| 4,781,532 | 11/1988 | Novacek et al. | 416/222 |
| 4,840,539 | 6/1989 | Bourcier et al. | 416/191 |
| 5,100,292 | 3/1992 | Matula et al. | 416/220 R |
| 5,174,720 | 12/1992 | Gradl | 416/222 X |
| 5,211,540 | 5/1993 | Evans | 416/191 |
| 5,238,368 | 8/1993 | Ortolano | 416/191 |
| 5,261,785 | 11/1993 | Williams . | |
| 5,267,834 | 12/1993 | Dinh et al. . | |
| 5,299,915 | 4/1994 | Dinh et al. . | |
| 5,320,483 | 6/1994 | Cunha et al. . | |

FOREIGN PATENT DOCUMENTS

| | | | |
|---|---|---|---|
| 52-57408 | 5/1977 | Japan | 416/222 |
| 3-26801 | 2/1991 | Japan | 416/191 |
| 101549 | 3/1941 | Sweden | 416/222 |
| 2072760 | 10/1980 | United Kingdom | 416/191 |

OTHER PUBLICATIONS

GE Turbine Reference Library—GE Power Generation "Recent Advances in Mechanical Drive Turbine Technology"; 1989.

*Primary Examiner*—Edward K. Look
*Assistant Examiner*—Michael S. Lee
*Attorney, Agent, or Firm*—Nixon & Vanderhye

[57] ABSTRACT

A turbine wheel and bucket assembly comprising a wheel having a peripheral rim machined to include a dovetail shape about the circumference of the rim, interrupted only by a bucket installation slot; and a plurality of buckets installed on the wheel, each bucket having a dovetail portion and blade portion, with the dovetail portion machined to include a complimentary dovetail shape enabling each bucket to be slidably received on the wheel dovetail shape; each bucket having an integral cover at a radial tip of the blade portion, each cover having axially extending surfaces on either side of angled contact surfaces adapted to engage mating contact surfaces of adjacent covers such that the buckets are pretwisted in a first direction. The dovetail shape includes a keyway and a complimentary key is provided on the rim of the wheel, the key receivable within the keyway to prevent rotation of the dovetail portion of the bucket relative to the wheel.

16 Claims, 3 Drawing Sheets

TURBINE BUCKET AND WHEEL ASSEMBLY WITH INTEGRAL BUCKET SHROUD

TECHNICAL FIELD

This invention relates to steam turbines in general, and to steam turbine rotor buckets having integral covers or shrouds in particular.

BACKGROUND

Integral covers or shrouds for steam turbine blades (usually referred to as buckets) must maintain contact from bucket to bucket in a row, to dampen vibratory stimuli and control natural frequencies. During operation, centrifugal force will cause radial growth and twisting of bucket vanes, tending to open circumferential gaps between the covers. Therefore, the covers must be assembled with enough compressive contact force between adjacent buckets to provide residual force during operation, despite the counteracting effects of centrifugal force.

Some turbine manufacturers use tangential entry buckets with internal wheel dovetails and covers, each having a rombic outline. In order to enter the wheel groove, the buckets must twist, which compresses the circumferential length of the covers. The sides of the wheel dovetail prevent untwisting of the buckets. Hydraulic rams are used to move the buckets around the wheel rim and fit them tightly together.

Other turbine manufacturers use pins to hold the buckets tightly together at assembly. Here again, it may be required to use hydraulic rams to place the covers in compression before installing such pins.

Examples of turbine bucket cover or shroud configurations may also be found in U.S. Pat. Nos. 4,840,539; 4,710,102; 3,981,615; 3,752,599; 3,572,968; 3,328,867; 3,185,441; 3,107,897; 2,942,843; 2,315,611; 2,220,918; 1,423,466; 1,247,400 and 1,149,366.

It is the object of this invention to provide an improved integral bucket cover configuration for tangential entry external wheel dovetails which maintain the necessary contact from bucket to bucket within the row.

DISCLOSURE OF THE INVENTION

In the exemplary embodiment, a turbine bucket integral shroud or cover configuration introduces a pretwist into the buckets by reason of an interference fit along contact surfaces on covers of adjacent buckets. More specifically, the mating contact surfaces have steep locking angles which create a mechanical advantage which, in turn, converts a nominal tangential force into a significant axial force to cause the cover rotation or pretwist. This pretwist is necessary to insure that the covers stay coupled at speed and do not become free-standing. It has been observed in testing, however, that not only do the covers and vanes rotate, but the dovetails which connect the buckets to the wheel, rotate as well. Dovetail rotation is very undesirable since it will decrease the intended cover pre-load, and may lead to a free-standing bucket cover. In other words, the cover pretwist can be lost when a significant portion of that pretwist is taken up by a rotated dovetail that has been locked in the rotated position in an assembled row of buckets. As the row comes up to speed, centrifugal and thermal growths cause the covers to lose the preload. In addition to bucket covers losing their pretwist, a rotated dovetail may cause an additional problem of increased tang (the innermost radial wheel profile cooperating with the innermost radial bucket dovetail geometry) loading which would likely increase the chances of tang cracking in the field. Accordingly, this invention also incorporates a unique locking key which may be formed integral with the wheel, or which may be provided in the form of discrete segments spanning several buckets, and which is effective to prevent dovetails from rotating by reason of a fight axial clearance between the key and associated keyway that has been machined into the dovetail.

In its broadest aspect, the invention relates to a turbine wheel and bucket assembly comprising a wheel having a peripheral rim machined to include a dovetail shape about the circumference of the rim, interrupted only by a bucket installation slot; and a plurality of buckets installed on the wheel, each bucket having a dovetail portion and blade portion, with the dovetail portion machined to include a complementary dovetail shape enabling each bucket to be slidably received on the wheel dovetail shape; each bucket having an integral cover at a radial tip of the blade portion, the cover incorporating first means for introducing pretwist into each blade portion of the plurality of buckets, and the wheel dovetail shape and the bucket dovetail shape incorporating second means for preventing rotation of the bucket dovetail portion.

In another aspect, the present invention relates to a turbine wheel and bucket assembly comprising a wheel having a peripheral rim machined to include a dovetail shape about the circumference of the rim, interrupted only by a bucket installation slot; and a plurality of buckets installed on the wheel, each bucket having a dovetail portion and blade portion, with the dovetail portion machined to include a complementary dovetail shape enabling each bucket to be slidably received on the wheel dovetail shape; each bucket having an integral cover at a radial tip of the blade portion, each cover having axially extending surfaces on either side of angled contact surfaces adapted to engage mating contact surfaces of adjacent covers such that the buckets are pretwisted in a first direction.

In still another aspect, the invention relates to a turbine wheel and bucket assembly comprising a wheel having a peripheral rim machined to include a dovetail shape about the circumference of the rim, interrupted only by a bucket installation slot; and a plurality of buckets installed on the wheel, each bucket having a dovetail portion and blade portion, with the dovetail portion machined to include a complementary dovetail shape enabling each bucket to be slidably received on the wheel dovetail shape; and further including a keyway formed in the dovetail portion and a key provided on the rim, the key receivable within the keyway to prevent rotation of the dovetail portion of the bucket relative to the wheel.

The present invention thus provides integral shroud covers for turbine blades or buckets which introduces pretwist into the blades, but which prevents concurrent twisting of the dovetail portion of the bucket. Additional objects and advantages will become apparent from the detailed description which follows.

BEST MODE FOR CARRYING OUT THE INVENTION

Figure 1:
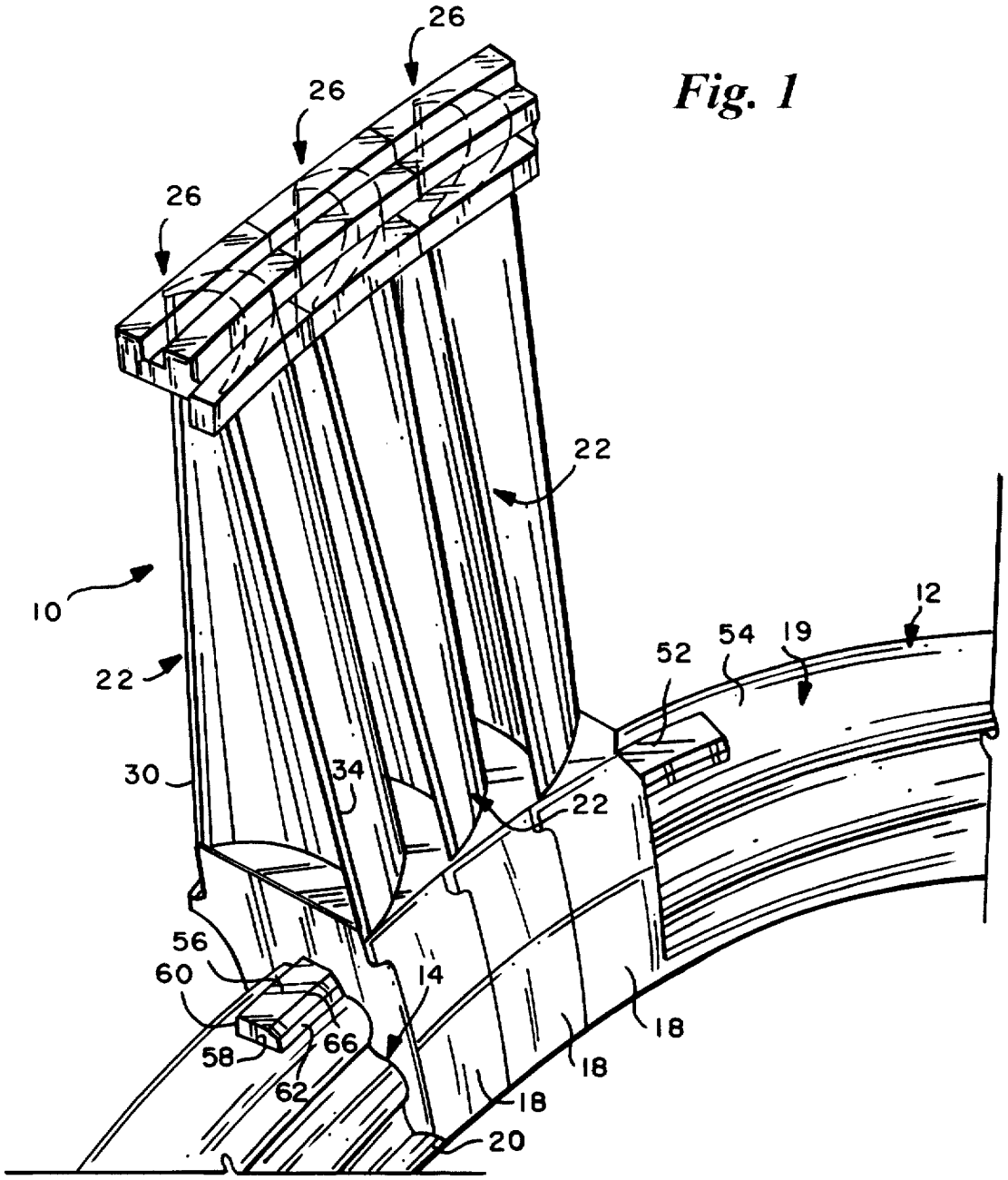
FIG. 1 is a partial perspective of a turbine rotor wheel with buckets mounted thereon in accordance with this invention.
Figure 2:
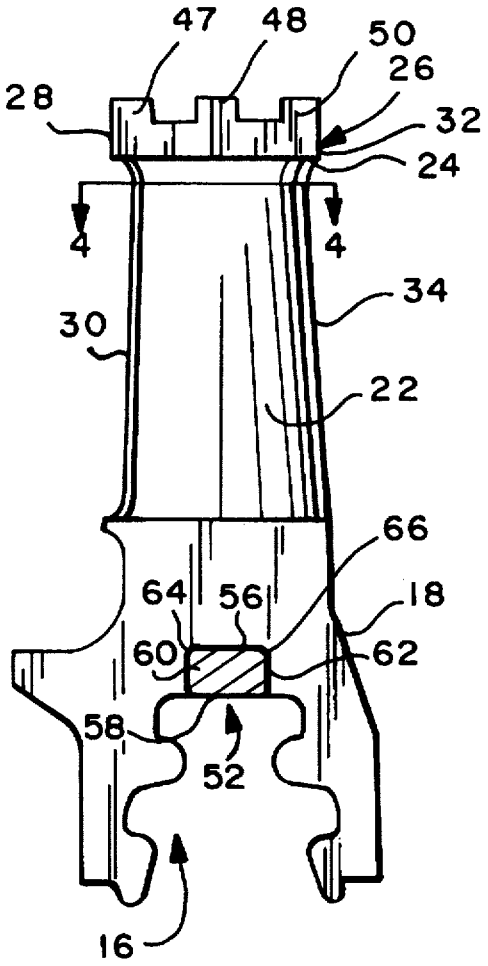
FIG. 2 is a side elevation of a turbine bucket in accordance with the invention.

With reference to FIG. 1, a plurality of turbine blades or buckets 10 are secured to a turbine rotor wheel 12 by means of a dovetail shape generally indicated at 14. The buckets 10 (three of which are shown) extend a full 360° about the turbine wheel 12, thereby forming a "row" of buckets. Each bucket is identical, with the exception of the last bucket (or "notch blade") which can have a larger interference fit or tangential width, and two buckets adjacent the notch blade which differ only in the dovetail area. As best seen in FIG. 2, each dovetail joint 14 includes a "pinetree" shaped slot 16 formed in the dovetail portion 18 of the bucket, and this slot is designed for mating and sliding engagement with a complementary dovetail shape 19 formed on the rim of the rotor wheel 12. The buckets 10 are designed to be added to the rotor wheel 12 via a radial filling slot formed in the wheel rim in the usual manner, i.e., by moving a bucket radially into the slot and then sliding the bucket tangentially along the dovetail tang 20. This process is repeated until an entire row of buckets 10 are mounted on the wheel. The last bucket, or so called "notch blade" is then moved radially (only) into the fill slot and secured therein in a conventional manner.

Figure 3:
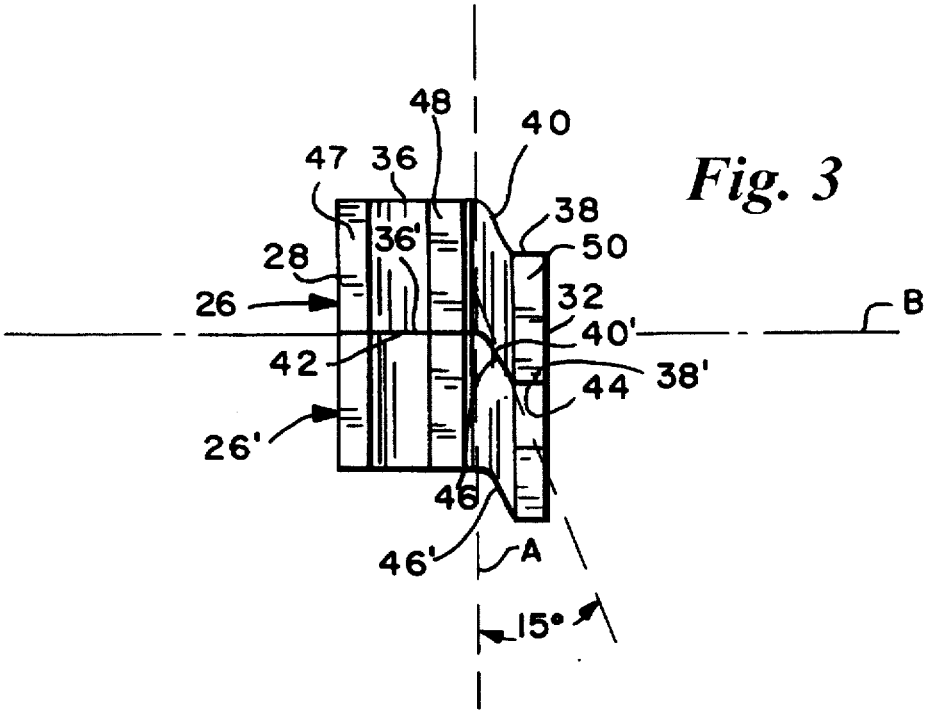
FIG. 3 is a partial plan view illustrating the manner in which adjacent bucket covers or shrouds interlock in accordance with this invention.

Blades 22 of the buckets 10 extend upwardly from the dovetail portion 18 to respective tips 24. Each tip 24 is formed with an integral cover 26 which couple the entire row of buckets together, substantially 360 ° about the wheel 12. Since the covers 26 are identical, only one need be described in detail. With reference now particularly to FIGS. 1 and 3, the cover or shroud 26 when viewed in plan (FIG. 3) has an edge 28 adjacent the blade leading edge 30 and an edge 32 adjacent the blade trailing edge 34. Given the above orientation, the cover 26 also includes on one side axially extending parallel edges 36, 38 connected by angled (and radiused) edge 40, and on the other side axially extending edges 42, 44 connected by angled (and radiused) edge 46. It will be appreciated that leading edge 28 is parallel to trailing edge 32 and that these edges extend perpendicular to the axis of rotation of the wheel, indicated by the letter B in FIG. 3; that axial side edges 36 and 38 are parallel to axial side edges 42, 44; and that connecting edge or surface 40 is parallel to connecting edge or surface 46.

It is the surfaces 40 and 46 which provide the steep angle locking or contact surfaces which introduce pretwist into the buckets 10 as they are slid tangentially into snug, abutting relationship as shown in FIG. 3. Thus, when coupled as shown in FIG. 3, the connecting edge 46 of cover 26 and connecting edge 40' of the adjacent cover 26' define the steeply angled contact surfaces which extend at approximately 15° relative to a tangent to the periphery of the blade or cover, indicated by letter A. Along these contact surfaces, there is an interference fit of between about 5 and about 70 mils, depending on the particular application. In addition, there is an axial edge clearance at the interface of edges 42 and 44 with edges 36', 38', respectively, of about 4 to 20 mils, again depending on the particular application. In general, shorter bucket lengths will have an interference and clearance fit in the lower end of the range, and longer length buckets will have an interference and clearance fit in the higher end of the range. The interference fit maintains contact at the contact surfaces, and the clearance fit maintains clearance at the interface of edges 42 and 44 with edges 36', 38' during assembly and at the temperature and operating speed of the turbine.

Figure 4:
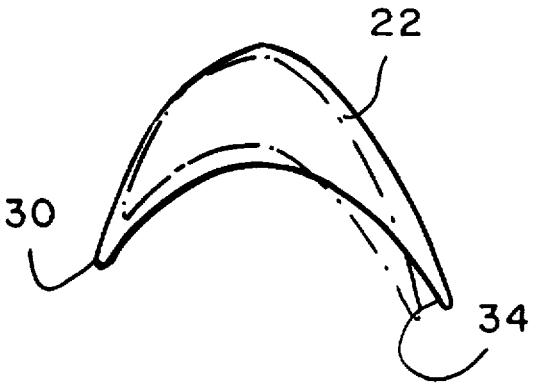
FIG. 4 is a plan view of a bucket or blade profile, indicating the manner in which the blades are pretwisted in accordance with the invention.

With reference also to FIG. 4, it will be appreciated that the interference fit along surfaces 46 of cover 26 and 40' of cover 26' pretwists the underlying blades in a counterclockwise direction from the dotted line position to the solid line position. This pretwist is necessary to insure that the covers 26 stay coupled (i.e., form a continuous 360°) at rated turbine speed, and do not become free standing as a result of centrifugal forces generated when the turbine is operating at speed.

It should be noted that the cover 26 is also formed with three vertical ribs or crowns 47, 48 and 50 (see FIGS. 1 and 2) which extend substantially continuously (when the buckets are in place on the wheel) about the wheel, and which are utilized as part of a blade tip leakage control arrangement, otherwise not part of this invention.

It has also been determined, however, that the pretwist described above introduces an undesirable effect in that the dovetail portion 18 and specifically the dovetail joint 14 tends to rotate or twist with the blade thereby increasing the loading on the tang 20 of the rotor wheel 12. Dovetail rotation is very undesirable for the reasons already presented above.

Thus, it is a further feature of this invention to incorporate an anti-rotation key 52 as shown in both FIGS. 1 and 2. The anti-rotation key 52 is provided on the upper horizontal surface 54 of the rotor wheel 12. The key itself is substantially rectangular in cross section with parallel top and bottom surfaces 56, 58, respectively, and parallel side surfaces 60 and 62. The intersection of top surface 56 and side surfaces 60, 62 are bevelled as shown at 64, 66.

In accordance with the invention, the key 52 can be machined into the wheel 12, or alternatively, can be provided in the form of a plurality of segments (one shown in FIG. 1), simply laid on top of the wheel 12 and held in place by the plurality of buckets 6. In the latter case, individual key segments may be between about 18 and about 24 inches in length, depending on wheel diameter. Thus, the key can span any number of buckets from 5 to 25, or whatever is practical considering the economics and manufacturability of the keys. Again depending on wheel diameter, as many as eighteen individual keys may be employed about the circumference of the wheel. In any event, the one or more keys 52 effectively prevent rotation of dovetails 14 despite the pretwist introduced by covers 26.

It should be appreciated that while the primary purpose of key 52 is to minimize dovetail rotation, it can also be used to locate the buckets both axially and radially on the wheel. This axial and radial location of the bucket 10 on the wheel 12 is currently established by fight axial and radial fits at the tang of the dovetail. The use of an anti-rotation key may eliminate the need for this tight tang fit, and antecedent face-off operation. Further in this regard, a tight axial clearance between the key and keyway along side surfaces 60, 62 of up to about 0.0035 inch is required in order to control dovetail rotation within acceptable limits. Radial clearance between the key and keyway along top surface 56 may be as high as 0.030 inch.

Figure 5:
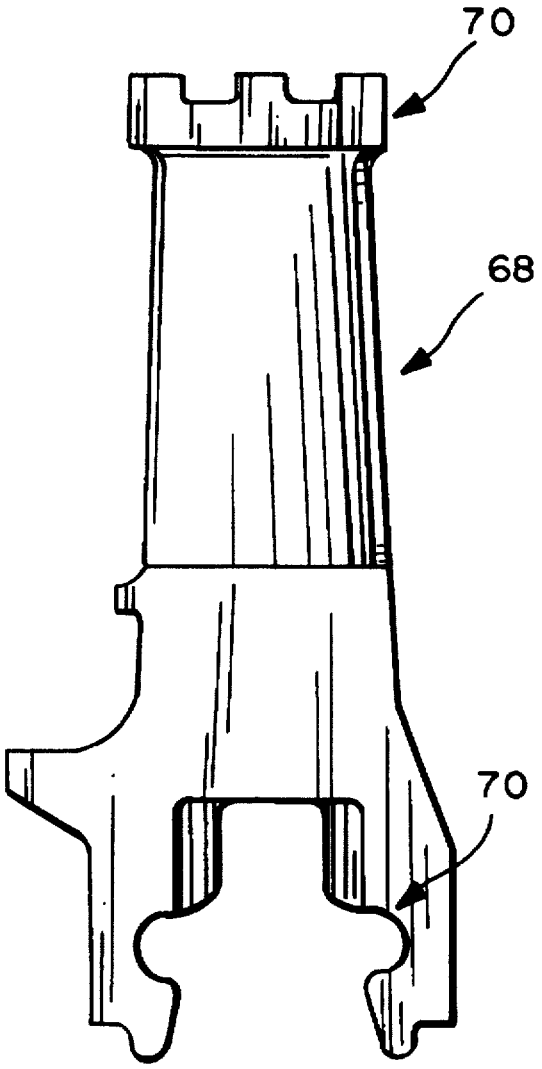
FIG. 5 is a side elevation of a notch blade in accordance with the invention.

A last bucket 68, also known as a notch blade, is shown in FIG. 5. This notch blade or bucket 68 is the last bucket mounted on the wheel 12 and, in conventional fashion, is inserted into the fill slot via radial movement only. The notch blade 68 is formed with an integral cover 70 similar to those of the remaining buckets so as to complete the circumferentially closed "cover". However, the cover 70 on the notch blade can have an increased interference fit and an increased tangential width of up to about 35 percent to compensate for the larger pitch of the notch blade. At the same time, it will be appreciated that the dovetail joint 70 can be modified to the simpler configuration since the notch blade is not moved tangentially along the wheel. The blade is secured in place in the usual manner, the otherwise conventional notch blade shown having the notch blade cover or shroud 70 that is identical to the cover or shroud 26 provided on the remaining buckets or blades.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A turbine wheel and bucket assembly comprising a wheel having an axis rotation and a peripheral rim machined to include a dovetail shape about the circumference of said rim, interrupted only by a bucket installation slot; and a plurality of buckets installed on said wheel, each bucket having a dovetail portion and blade portion, with the dovetail portion machined to include a complementary dovetail shape enabling each said bucket to be slidably received on said wheel dovetail shape; each bucket having an integral cover at a radial tip of said blade portion, each cover having circumferentially spaced sides, each side having axially extending surfaces joined by an angled contact surface in mating engagement with contact surfaces of adjacent covers, wherein said contact surfaces extend at an angle to a radial plane perpendicular to said axis of rotation sufficient to cause said buckets to be pretwisted in a first direction during assembly of the buckets on the wheel.

2. The assembly of claim 1 wherein said angle is about 15.

3. The assembly of claim 1 wherein said axially extending surfaces of adjacent covers have a clearance of about 4 to 20 mils.

4. The assembly of claim 1 wherein said contact surfaces of adjacent covers have an interference fit of between about 5 and about 70 mils.

5. A turbine wheel and bucket assembly comprising a wheel having a peripheral rim machined to include a dovetail shape about the circumference of said rim, interrupted, only by a bucket installation slot; and a plurality of buckets installed on said wheel, each bucket having a dovetail portion and blade portion, with the dovetail portion machined to include a complementary dovetail shape enabling each said bucket to be slidably received on said wheel dovetail shape; each bucket having an integral cover at a radial tip of said blade portion, each cover having axially extending surfaces on either side of angled contact surfaces adapted to engage mating contact surfaces of adjacent covers such that said buckets are pretwisted in a first direction and further including a keyway formed in said bucket dovetail portion and a key provided on said rim, said key receivable within said keyway to prevent rotation of said dovetail portion of the bucket relative to the wheel.

6. The assembly of claim 5 wherein said key is machined into said wheel.

7. The assembly of claim 5 wherein the key is provided in the form of discrete segments.

8. The assembly of claim 5 wherein the key is held on said wheel only by reason of cooperation between said dovetail shapes.

9. A turbine wheel and bucket assembly comprising a wheel having a peripheral rim machined to include a dovetail shape about the circumference of said rim, interrupted only by a bucket installation slot; and a plurality of buckets installed on said wheel, each bucket having a dovetail portion and blade portion, with the dovetail portion machined to include a complementary dovetail shape enabling each said bucket to be slidably received on said wheel dovetail shape; and further including a keyway formed in said dovetail portion and a key provided on said rim, said key receivable within said keyway to prevent rotation of said dovetail portion of the bucket relative to the wheel.

10. The assembly of claim 9 wherein said key is machined into said wheel.

11. The assembly of claim 9 wherein the key is provided in the form of discrete segments.

12. The assembly of claim 11 wherein one of said discrete segments spans between 5 and 25 buckets.

13. The assembly of claim 9 wherein the key is held on said wheel only by reason of cooperation between said dovetail shapes.

14. The assembly of claim 9 wherein said key includes top and parallel side surfaces, and said keyway includes complementary surfaces adjacent said top and parallel side surfaces, and further wherein a clearance of up to about 0.0035 inch is provided between each side surface of said key and respective complementary surface of said keyway.

15. The assembly of claim 9 wherein each bucket is provided with an integral cover at a radial tip of the blade portion, each cover adapted for mating engagement with the covers of adjacent buckets, wherein said integral cover includes surface means for producing a pretwist into said plurality of buckets when assembled on said wheel.

16. A turbine wheel and bucket assembly comprising a wheel having a peripheral rim machined to include a dovetail shape about the circumference of said rim, interrupted only by a bucket installation slot; and a plurality of buckets installed on said wheel, each bucket having a dovetail portion and blade portion, with the dovetail portion machined to include a complementary dovetail shape enabling each said bucket to be slidably received on said wheel dovetail shape; each bucket having an integral cover at a radial tip of said blade portion, said cover incorporating first means for introducing pretwist into each said blade portion of said plurality of buckets, and said wheel dovetail shape and said bucket dovetail shape incorporating second means for preventing rotation of said bucket dovetail portion.

* * * * *

UNITED STATES PATENT AND TRADEMARK OFFICE

CERTIFICATE OF CORRECTION

PATENT NO. : 5,509,784
DATED : April 23, 1996
INVENTOR(S) : CARUSO et al.

It is certified that error appears in the above-identified patent and that said letters patent is hereby corrected as shown below:

On the title page, item [75] on the face of the patent, insert the following additional inventors:

--Dennis W. Roberts, Schenectady, New York; and John Van Nest, Schenectady, New York--.

Signed and Sealed this

Tenth Day of December, 1996

*Attest:*

*Attesting Officer*

Bruce Lehman

BRUCE LEHMAN

*Commissioner of Patents and Trademarks*